US011953229B2

(12) United States Patent
Ugalde et al.

(10) Patent No.: US 11,953,229 B2
(45) Date of Patent: Apr. 9, 2024

(54) ADAPTIVE HVAC SUPPORT STRUCTURE

(71) Applicant: CARRIER CORPORATION, Palm Beach Gardens, FL (US)

(72) Inventors: Alan Ugalde, General Escobedo (MX); David E. M. Salisbury, Oneida, NY (US); Jeremy Babb, Kennesaw, GA (US); Jesus Toro, General Escobedo (MX); Elvira Martinez, San Nicolas de Los Garza (MX); Jonathan Emmanuel Salgado, Garcia (MX)

(73) Assignee: CARRIER CORPORATION, Palm Beach Gardens, FL (US)

( * ) Notice: Subject to any disclaimer, the term of this patent is extended or adjusted under 35 U.S.C. 154(b) by 154 days.

(21) Appl. No.: 17/831,815

(22) Filed: Jun. 3, 2022

(65) Prior Publication Data

US 2022/0412605 A1 Dec. 29, 2022

Related U.S. Application Data

(60) Provisional application No. 63/214,408, filed on Jun. 24, 2021.

(51) Int. Cl.

| | |
|---|---|
| ***F24F 13/32*** | (2006.01) |
| ***F24F 13/02*** | (2006.01) |
| ***F24F 13/20*** | (2006.01) |

(52) U.S. Cl.

CPC ..... *F24F 13/32* (2013.01); *F24F 13/02* (2013.01); *F24F 13/20* (2013.01); *F24F 2221/16* (2013.01)

(58) Field of Classification Search

CPC .. F24F 13/32; F24F 13/02; F24F 13/20; F24F 2221/16

See application file for complete search history.

(56) References Cited

U.S. PATENT DOCUMENTS

| | | | |
|---|---|---|---|
| 3,520,245 | A | 7/1970 | Painter |
| 4,016,729 | A | 4/1977 | Cherry |
| 4,018,266 | A | 4/1977 | Kay |
| 4,118,083 | A | 10/1978 | Lackey et al. |
| 4,403,481 | A | 9/1983 | Yoho, Sr. |
| 4,413,450 | A | 11/1983 | Brower |
| 4,501,193 | A | 2/1985 | Trigourea |
| 4,683,942 | A | 8/1987 | Bierkamp et al. |
| 5,454,538 | A | 10/1995 | Merideth |

(Continued)

FOREIGN PATENT DOCUMENTS

| | | |
|---|---|---|
| CN | 107747354 B | 12/2019 |

*Primary Examiner* — Anita M King

(74) *Attorney, Agent, or Firm* — Carlson, Gaskey & Olds, P.C.

(57) ABSTRACT

An illustrative example embodiment of a structure for supporting a heating, ventilation and air conditioning (HVAC) unit includes a frame having support members configured to be situated beneath the HVAC unit to support a weight of the HVAC unit, which is directed in a vertical direction. The frame is at least partially situated in a plane that is perpendicular to the vertical direction. A supply air passage and a return air passage are supported by the frame. The return air passage has a first side and a second side opposite the first side. The first side is oriented at a first oblique angle relative to the plane. The second side is oriented at a second oblique angle relative to the plane. The first oblique angle is different than the second oblique angle.

20 Claims, 3 Drawing Sheets

(56) References Cited

U.S. PATENT DOCUMENTS

| | | | | |
|---|---|---|---|---|
| 5,522,768 | A | 6/1996 | Brodt et al. | |
| 5,687,514 | A | 11/1997 | Gillispie | |
| 6,041,557 | A | 3/2000 | Brown et al. | |
| 6,795,300 | B1 | 9/2004 | Holley | |
| 7,065,928 | B1 * | 6/2006 | Lane | E04D 13/0315 52/60 |
| 8,540,557 | B1 | 9/2013 | Derks et al. | |
| 8,640,477 | B1 * | 2/2014 | Merideth | F24F 13/32 62/298 |
| 8,960,620 | B1 | 2/2015 | Merideth | |
| 9,134,040 | B2 | 9/2015 | Desmond et al. | |
| 9,249,980 | B2 | 2/2016 | Tollar | |
| 9,441,855 | B2 | 9/2016 | Marks | |
| 9,625,175 | B2 * | 4/2017 | Desmond | E04D 13/00 |
| 10,578,337 | B2 | 3/2020 | Benton | |
| 10,633,864 | B2 | 4/2020 | Dempster | |
| 2015/0027066 | A1 * | 1/2015 | Desmond | F24F 13/081 52/27 |
| 2015/0354867 | A1 | 12/2015 | Bloch | |
| 2020/0063986 | A1 | 2/2020 | Ramanjam et al. | |
| 2020/0370782 | A1 | 11/2020 | Tamboli et al. | |

* cited by examiner

ADAPTIVE HVAC SUPPORT STRUCTURE

CROSS REFERENCE TO RELATED APPLICATION

This application claims priority to U.S. Provisional Application No. 63/214,408, which was filed on Jun. 24, 2021.

BACKGROUND

There are a variety of heating, ventilation, and air conditioning (HVAC) systems for controlling the temperature within a building. Many larger buildings include a rooftop HVAC unit mounted on the roof. There are situations that require replacement of the rooftop HVAC unit, such as when the system no longer functions as desired.

One challenge associated with replacing rooftop HVAC units is that the replacement unit may not be configured the same as the one being replaced. The ductwork at the roof interface and the supporting structure are configured to be compatible with the old unit. The ductwork typically cannot be easily replaced or reconfigured without disturbing other parts of the system or finish materials in the building interior. Such changes introduce additional expense and potentially interfere with proper system operation. Additionally, the existing supporting structure may interfere with or block some of the necessary airflow because of the different configuration of the replacement HVAC unit.

SUMMARY

An illustrative example embodiment of a structure for supporting a HVAC unit includes a frame having support members configured to be situated beneath the HVAC unit to support a weight of the HVAC unit, which is directed in a vertical direction. The frame is at least partially situated in a plane that is perpendicular to the vertical direction. A supply air passage and a return air passage are supported by the frame. The return air passage has a first side and a second side opposite the first side. The first side is oriented at a first oblique angle relative to the plane. The second side is oriented at a second oblique angle relative to the plane. The first oblique angle is different than the second oblique angle.

In addition to one or more of the features described above, or as an alternative, a difference between the first oblique angle and the second oblique angle is in a range from 1° to 5°.

In addition to one or more of the features described above, or as an alternative, the difference between the first oblique angle and the second oblique angle is in a range from 2° to 4°.

In addition to one or more of the features described above, or as an alternative, the difference between the first oblique angle and the second oblique angle is less than 3°.

In addition to one or more of the features described above, or as an alternative, the difference between the first oblique angle and the second oblique angle is less than 2°.

In addition to one or more of the features described above, or as an alternative, a ratio of the first oblique angle to the second oblique angle is between 1.01 and 1.10.

In addition to one or more of the features described above, or as an alternative, the ratio is at least 1.03.

In addition to one or more of the features described above, or as an alternative, the ratio is at least 1.05.

In addition to one or more of the features described above, or as an alternative, the ratio is at least 1.07.

In addition to one or more of the features described above, or as an alternative, the supply air passage includes a first side at a third oblique angle relative to the plane, the supply air passage includes a second side opposite the first side, and the second side of the supply air passage is at a fourth oblique angle relative to the plane.

In addition to one or more of the features described above, or as an alternative, a difference between the third oblique angle and the fourth oblique angle is between 0° and 20°.

In addition to one or more of the features described above, or as an alternative, the difference between the third oblique angle and the fourth oblique angle is between 5° and 17°.

In addition to one or more of the features described above, or as an alternative, the difference between the third oblique angle and the fourth oblique angle is between 6° and 13°.

In addition to one or more of the features described above, or as an alternative, the difference between the third oblique angle and the fourth oblique angle is less than 10°.

In addition to one or more of the features described above, or as an alternative, a ratio of the third oblique angle to the fourth oblique angle is between 1.1 and 1.3.

In addition to one or more of the features described above, or as an alternative, the ratio is at least 1.1.

In addition to one or more of the features described above, or as an alternative, the ratio is at least 1.2.

In addition to one or more of the features described above, or as an alternative, a cover adjacent one side of the frame includes at least one panel that is situated at an oblique angle relative to the plane.

In addition to one or more of the features described above, or as an alternative, the cover includes reinforcing members across the cover, the reinforcing members protrude away from the at least one panel, and the reinforcing members are situated at a sloping angle to direct fluid drainage toward one side of the cover.

In addition to one or more of the features described above, or as an alternative, the cover includes a mounting flange along at least two edges of the cover and the mounting flange is aligned with the vertical direction.

The various features and advantages of at least one disclosed example embodiment will become apparent to those skilled in the art from the following detailed description. The drawings that accompany the detailed description can be briefly described as follows.

DETAILED DESCRIPTION

Figure 1:
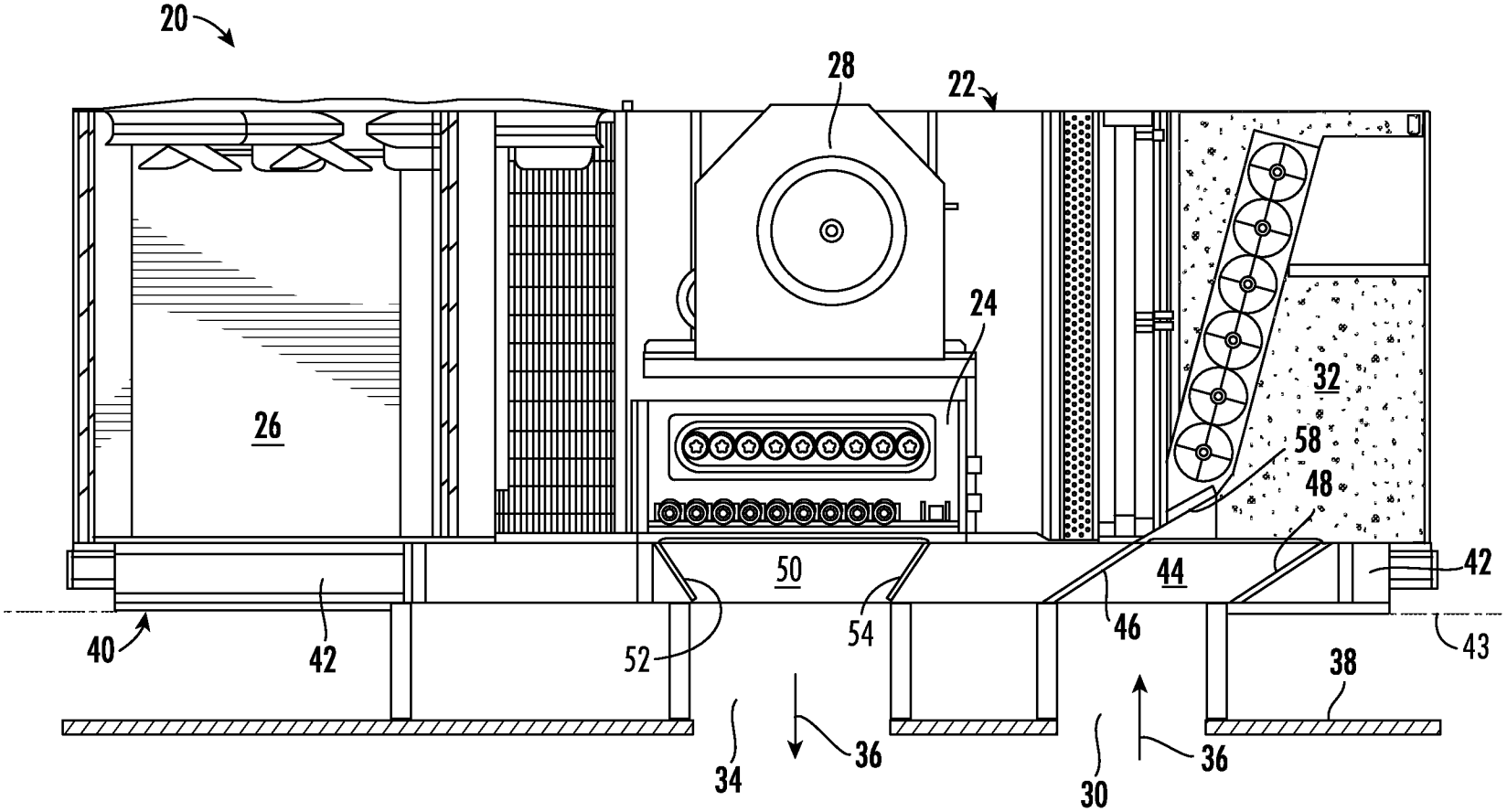
FIG. 1 schematically illustrates an example embodiment of a structure supporting a heating, ventilation and air conditioning (HVAC) unit.

FIG. 1 schematically illustrates selected portions of an example embodiment of a rooftop heating, ventilation and air conditioning (HVAC) system 20. A HVAC unit 22 includes a refrigeration circuit that is capable of providing cooling when operating as an air conditioner and heating when operating as a heat pump or furnace. The HVAC unit 22 houses the evaporator portion and the compressor portion of the refrigeration circuit. An air moving system 28 causes air flow from a return air duct 30, through an economizer section 32, across the evaporator portion or a burner in a housing section 24, and into a supply air duct 34.

The return air duct 30 and the supply air duct 34 are connected to a duct system within a building (not illustrated). The primary air flow direction through the supply air duct 30 and the return air duct 34 is a vertical direction 36, which is generally perpendicular to a roof 38 of the building.

Figure 2:
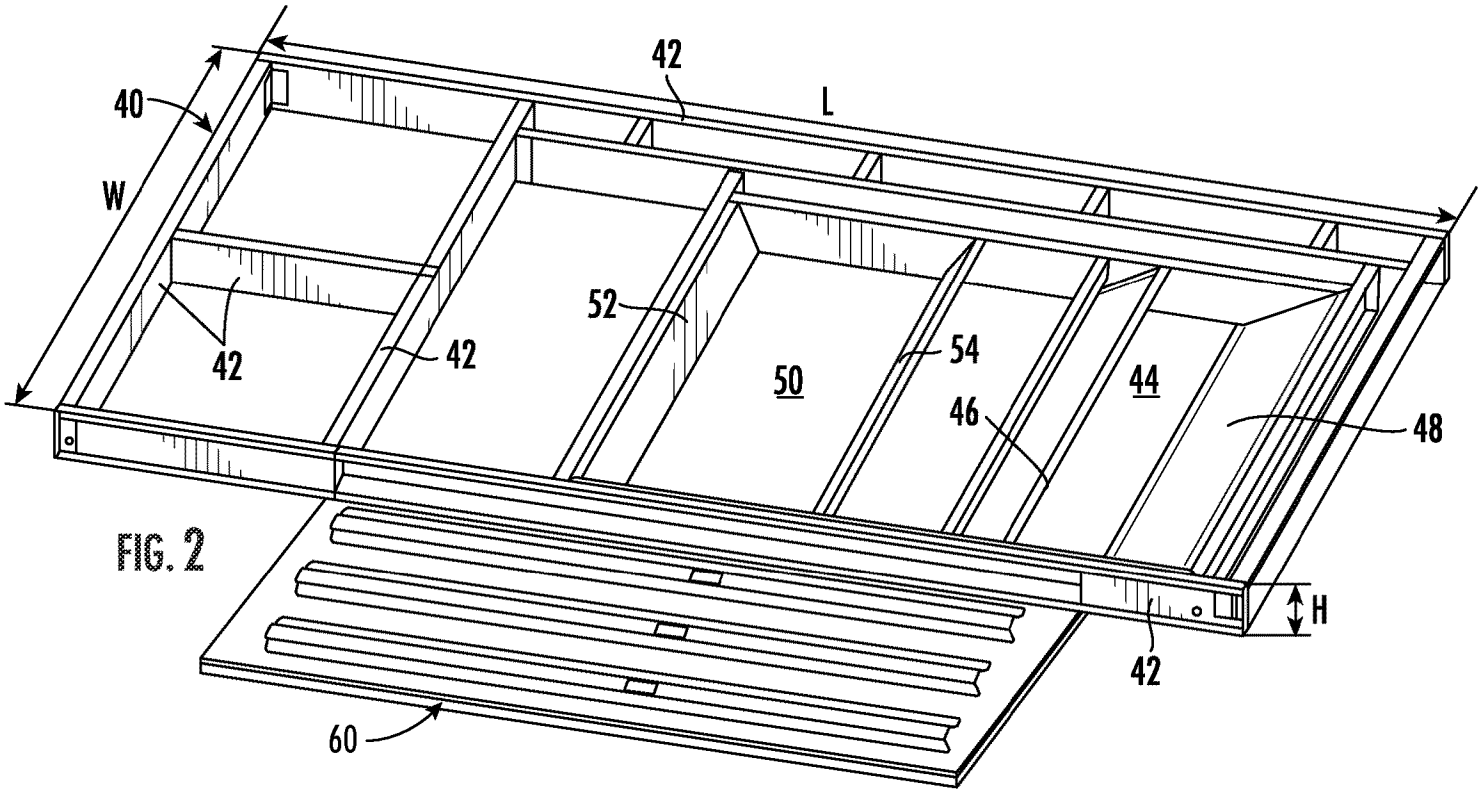
FIG. 2 is a perspective illustration of the supporting structure of the embodiment of FIG. 1.
Figure 3:
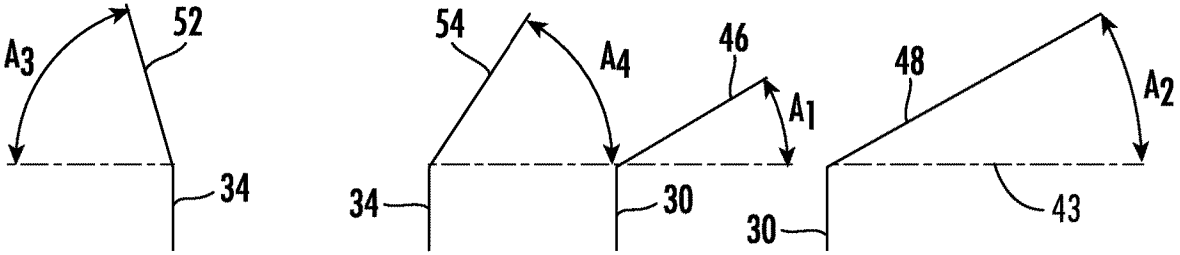
FIG. 3 schematically illustrates air passage surfaces at exemplary angles.

The HVAC unit 22 is supported on a structure 40. The weight of the HVAC unit 22 is directed downward in the vertical direction 36 because of gravity. As shown in FIGS. 1-3, the structure 40 includes a frame made up of support members 42, such as C-shaped beams or I-beams. The support members 42 define a length L, width W, and height H of the structure 40. The height H extends parallel to the vertical direction 36 when the structure 40 is installed on or above the roof 38. At least a portion of the frame of the structure 40 is situated in a plane 43 that is perpendicular to the vertical direction 36 and, in the illustrated example embodiment, parallel to the roof 38.

The structure 40 includes a return air passage 44 supported by the frame. The return air passage 44 is between the return air duct 30 and an inlet to the HVAC unit 22, which leads into the economizer section 32 in this example. The return air passage 44 includes a first side 46 and a second side 48. The first side 46 is oriented at a first oblique angle $A_1$ relative to the plane 43 (measured from the first side 46 to the plane 43, in a clock-wise fashion). At least some of the airflow through the return air duct 30 encounters the first side 46 as it passes through the return air passage 44. The first side 46 deflects or steers the air flow toward the entry of the economizer section 32, which is not aligned directly above the return air duct 30 because of differences between the configuration of the HVAC unit 22 and the installation of the return air duct 30. That misalignment may be the result of differences between the configuration of the HVAC unit 22 and another HVAC unit that was previously installed at the illustrated site.

The second side 48 is oriented at a second oblique angle $A_2$ relative to the plane 43 (measured from the second side 48 to the plane 43, in a clock-wise fashion). The second oblique angle $A_2$ is different than the first oblique angle $A_1$. A relationship between the different angles of orientation of the first side 46 and the second side 48 provides for directing the airflow through the return air passage 44 in an efficient manner that accommodates the offset alignment of the inlet to the economizer section 32 and the return air duct 30, minimizes or avoids turbulence, and maintains a desired pressure or rate of air flow into the HVAC unit 22.

The relationship between the first oblique angle $A_1$ and the second oblique angle $A_2$ is defined by a difference between the angles. In some such embodiments, the difference is in a range from 1° to 5°. In some embodiments, the range is from 2° to 4°. In some embodiments, the difference is less than 3°. In some embodiments, the difference is less than 2°. For example, the first oblique angle and the second oblique angle have respective values as shown in Table 1.

TABLE 1

| | | | | | |
|---|---|---|---|---|---|
| $A_1$ | 31° | 42° | 51° | 61° | 68° |
| $A_2$ | 29° | 40° | 48° | 59° | 66° |

In other embodiments, the relationship between the first oblique angle $A_1$ and the second oblique angle $A_2$ is defined by a ratio of the first oblique angle $A_1$ to the second oblique angle $A_2$. The ratio is in a range from 1.01 to 1.10. In some embodiments, the ratio is between 1.02 and 1.08. Example embodiments in which the ratio is in the range from 1.03 to 1.07 include first and second oblique angles as shown in Table 2.

TABLE 2

| | Ratio | | | | |
|---|---|---|---|---|---|
| | 1.07 | 1.05 | 1.06 | 1.03 | 1.03 |
| $A_1$ | 31° | 42° | 51° | 61° | 68° |
| $A_2$ | 29° | 40° | 48° | 59° | 66° |

If there is no difference between the first and second oblique angles or if the relationship between the first oblique angle and the second oblique angle includes a difference or a ratio outside of the ranges mentioned above, the return air passage 44 undesirably reduces pressure or the rate of air flow into the HVAC unit 22, such as by introducing turbulence, when the return air duct 30 is not directly aligned with the inlet to the economizer section 32. The relationships mentioned above make it possible to introduce a differently configured HVAC unit 22 in place of another that required the existing placement of the return air duct 30 and the supply air duct 34. The disclosed relationships between the first and second oblique angles establish an interface between the HVAC unit 22 and a variety of configurations of the return air duct 30 and the supply air duct 34 that accommodates spatial differences without hindering the HVAC system performance.

The structure 40 also supports a supply air passage 50 that is situated between an outlet of the HVAC unit 22 and the supply air duct 34. The supply air passage 50 includes a first side 52 and a second side 54. The first side 52 is oriented at a third oblique angle $A_3$ relative to the plane 43 (measured from the first side 52 to the plane 43, in a counter clock-wise fashion). The second side 54 is oriented at a fourth oblique angle $A_4$ relative to the plane 43 (measured from the second side 54 to the plane 43, in a clock-wise fashion). A relationship between the third oblique angle $A_3$ and the fourth oblique angle $A_4$ facilitates airflow between the HVAC unit 22 and the supply air duct 34 in a manner that minimizes or eliminates undesirable loss of pressure or rate of air flow.

In some embodiments the relationship between the third and fourth oblique angles is defined as a difference between the angles. In some embodiments, that difference is between 0° and 20°. In some such embodiments, the third oblique angle $A_3$ is equal to the fourth oblique angle $A_4$. In some embodiments, the difference between the third oblique angle $A_3$ and the fourth oblique angle $A_4$ is between 5° and 17°. The third oblique angle $A_3$ is different than the fourth oblique angle $A_4$ in all embodiments including the difference in that more limited range. Some embodiments include a range for the difference between the third oblique angle $A_3$ and the fourth oblique angle $A_4$ in a range from 6° and 13°. Some embodiments include a difference of less than 10°. Table 3 includes example third and fourth oblique angles.

TABLE 3

| | | | | | |
|---|---|---|---|---|---|
| $A_3$ | 74° | 79° | 82° | 84° | 86° |
| $A_4$ | 57° | 66° | 72° | 78° | 81° |

In some embodiments, the relationship between the third and fourth oblique angles is defined as a ratio of the third oblique angle $A_3$ to the fourth oblique angle $A_4$. That ratio is between 1.1 and 1.3 in embodiments configured like the embodiment shown in FIG. 1. Table 4 includes the ratio in example embodiments.

TABLE 4

| | Ratio | | | | |
|---|---|---|---|---|---|
| | 1.3 | 1.2 | 1.1 | 1.1 | 1.1 |
| $A_3$ | 74° | 79° | 82° | 84° | 86° |
| $A_4$ | 57° | 66° | 72° | 78° | 81° |

The embodiment of FIG. 1 includes an additional feature that facilitates a desired rate of air flow and pressure into the HVAC unit 22 from the return air duct 30. A surface 58 within the economizer section 32 is inclined relative to the vertical direction 36 at approximately the same angle as the first oblique angle $A_1$. In some embodiments, the surface 58 is oriented at the same angle as the first side 46 such that the surface 58 effectively becomes an extension of the first side 46 when the HVAC unit 22 is situated on the support 40. Orienting the surface 58 in this manner further minimizes or eliminates an undesirable reduction in pressure or air flow rate near the inlet to the economizer section 32.

Figure 4:
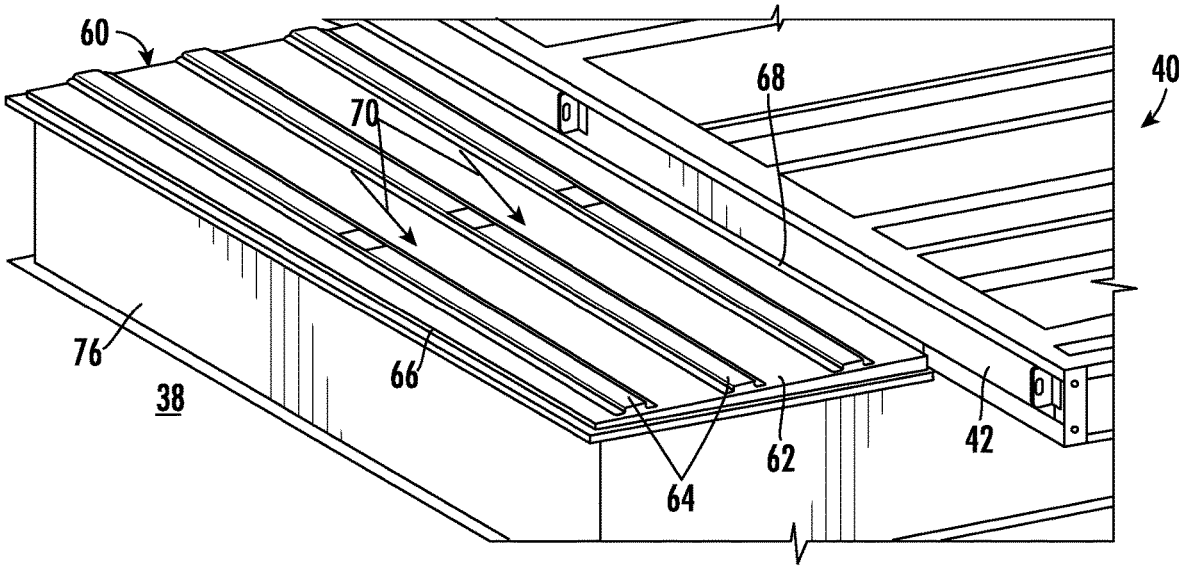
FIG. 4 is a perspective illustration of an example embodiment of a cover adjacent one side of the supporting structure.
Figure 5:
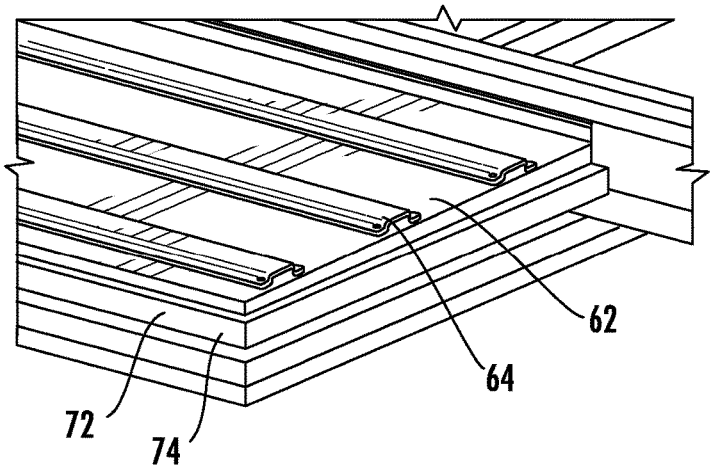
FIG. 5 illustrates a feature of the cover shown in FIG. 4.

As shown, the length L and width W of the structure 40 may be consistent with a length and width of the HVAC unit 22. In the illustrated example embodiment, the orientation of the HVAC unit 22 relative the opening through the roof 38 that is necessary to situate the return air passage 44 over the return air duct 30 and the supply air passage 50 over the supply air duct 34 leaves part of the opening through the roof 38 exposed. FIGS. 4 and 5 show a cover 60 that is situated adjacent one side of the structure 40 to close off an exposed part of that opening.

The example cover 60 includes a panel 62 that extends across a length and width of the cover 60. As shown, a plurality of reinforcing members 64 may be secured to the panel 62 and extend across the cover 60. The reinforcing members 64 in this example include C-shaped channels that protrude upward from the panel 62. The reinforcing members 64 in this example embodiment also provide surface features or gripping surfaces that facilitate an individual standing or walking on the cover 60 in a stabile manner.

The cover 60 is oriented at an oblique angle relative to the vertical direction 36. A first edge 66 of the cover 60, which is distal from the illustrated frame support member 42, is lower than a second edge 68, which is adjacent the illustrated support member 42. Sloping the cover 60 in this manner facilitates fluid drainage off of the cover 60. In the illustrated example embodiment, the reinforcing members 64 are at an oblique angle relative to the edges 66 and 68 and establish a fluid flow pattern indicated by the arrows 70.

The example cover 60 includes a mounting flange 72 situated along at least two edges of the panel 62. The mounting flange 72 is oriented parallel to the vertical direction 36 and is received adjacent a structural member 76 that defines part of the opening that the cover 60 closes. The mounting flange 72 is configured to receive fasteners 74 to secure the cover 60 in place without introducing holes in an upwardly facing surface of the cover 60, which reduces a likelihood of any moisture entering the opening through the roof 38.

A structure such as the illustrated example structure 40 with a return air passage 44 and a supply air passage 50 is useful for retrofitting buildings or systems with HVAC units that are not configured the same as previously installed equipment. Such structures are also useful for installing new systems in a manner that provides an increased tolerance for some offset between the inlet and outlet of the HVAC unit and the return air and supply air ducts. The relationships between the oblique angles described above allow for some offset without undesirably decreasing pressure or rate of air flow through the system. The disclosed relationships between the oblique angles establish an interface between the HVAC unit 22 and a variety of configurations of a return air duct 30 and supply air duct 34 that accommodates some vertical offset without hindering, or at least mitigating any hindering of, the HVAC system performance.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A structure for supporting a heating, ventilation and air conditioning (HVAC) unit, the structure comprising:

a frame comprising support members configured to be situated beneath the HVAC unit to support a weight of the HVAC unit, wherein the weight is directed in a vertical direction and at least a portion of the frame is situated in a plane perpendicular to the vertical direction;

a supply air passage supported by the frame; and a return air passage supported by the frame, the return air passage comprising a first side and a second side opposite the first side, the first side being oriented at a first oblique angle relative to the plane, the second side being oriented at a second oblique angle relative to the plane, wherein the first oblique angle is different than the second oblique angle.

2. The structure of claim 1, wherein a difference between the first oblique angle and the second oblique angle is in a range from 1° to 5°.

3. The structure of claim 2, wherein the difference between the first oblique angle and the second oblique angle is in a range from 2° to 4°.

4. The structure of claim 3, wherein the difference between the first oblique angle and the second oblique angle is less than 3°.

5. The structure of claim 3, wherein the difference between the first oblique angle and the second oblique angle is less than 2°.

6. The structure of claim 1, wherein a ratio of the first oblique angle to the second oblique angle is between 1.01 and 1.10.

7. The structure of claim 6, wherein the ratio is at least 1.03.

8. The structure of claim 6, wherein the ratio is at least 1.05.

9. The structure of claim 6, wherein the ratio is at least 1.07.

10. The structure of claim 1, wherein the supply air passage includes a first side at a third oblique angle relative to the plane;

the supply air passage includes a second side opposite the first side; and the second side of the supply air passage is at a fourth oblique angle relative to the plane.

11. The structure of claim 10, wherein a difference between the third oblique angle and the fourth oblique angle is between 0° and 20°.

12. The structure of claim 11, wherein the difference between the third oblique angle and the fourth oblique angle is between 5° and 17°.

13. The structure of claim 12, wherein the difference between the third oblique angle and the fourth oblique angle is between 6° and 13°.

14. The structure of claim 13, wherein the difference between the third oblique angle and the fourth oblique angle is less than 10°.

15. The structure of claim 10, wherein a ratio of the third oblique angle to the fourth oblique angle is between 1.1 and 1.3.

16. The structure of claim 15, wherein the ratio is at least 1.1.

17. The structure of claim 15, wherein the ratio is at least 1.2.

18. The structure of claim 1, comprising a cover adjacent one side of the frame, the cover comprising at least one panel that is situated at an oblique angle relative to the plane.

19. The structure of claim 18, wherein the cover comprises reinforcing members across the cover, the reinforcing members protrude away from the at least one panel, and the reinforcing members are situated at a sloping angle to direct fluid drainage toward one side of the cover.

20. The structure of claim 18, wherein the cover comprises a mounting flange along at least two edges of the cover and the mounting flange is aligned with the vertical direction.

* * * * *